US010421578B2

(12) United States Patent
Holley, Jr.

(10) Patent No.: US 10,421,578 B2
(45) Date of Patent: Sep. 24, 2019

(54) CARTON WITH HANDLE

(71) Applicant: Graphic Packaging International, Inc., Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 186 days.

(21) Appl. No.: 15/355,274

(22) Filed: Nov. 18, 2016

(65) Prior Publication Data

US 2017/0137165 A1 May 18, 2017

Related U.S. Application Data

(60) Provisional application No. 62/256,967, filed on Nov. 18, 2015.

(51) Int. Cl.
*B65D 5/46* (2006.01)
*B65D 5/10* (2006.01)
(Continued)

(52) U.S. Cl.
CPC ..... *B65D 5/46192* (2013.01); *B65D 5/10* (2013.01); *B65D 5/4266* (2013.01); *B65D 5/56* (2013.01);
(Continued)

(58) Field of Classification Search
CPC ..... B65D 5/4266; B65D 2571/00512; B65D 2571/00518; B65D 5/46192
(Continued)

(56) References Cited

U.S. PATENT DOCUMENTS 1,253,193 A 1/1918 Hill
2,681,143 A 6/1954 Guyer
(Continued)

FOREIGN PATENT DOCUMENTS

CA 1 243 987 11/1988
DE 296 07 374 4/1996
(Continued)

OTHER PUBLICATIONS

International Search Report and Written Opinion for PCT/US2016/062691 dated Feb. 13, 2017.

*Primary Examiner* — Anthony D Stashick
*Assistant Examiner* — Raven Collins
(74) *Attorney, Agent, or Firm* — Womble Bond Dickinson (US) LLP

(57) ABSTRACT

A carton for containing a plurality of articles is disclosed. The carton includes a plurality of panels that extends at least partially around an interior of the carton. The plurality of panels comprises a first top panel, a second top panel, a bottom panel, a first side panel, and a second side panel. The first top panel and the second top panel are at least partially overlapped to form a top wall of the carton. A plurality of end flaps comprises a first top end flap foldably connected to the first top panel and a second top end flap foldably connected to the second top panel. A handle extends in at least the top wall of the carton and comprises a first handle portion in the first top panel, a second handle portion in the second top panel, and a third handle portion in the closed end.

42 Claims, 6 Drawing Sheets

(51) Int. Cl.
*B65D 5/42* (2006.01)
*B65D 5/56* (2006.01)
*B65D 5/62* (2006.01)
*B65D 71/36* (2006.01)

(52) U.S. Cl.
CPC ..... *B65D 5/62* (2013.01); *B65D 71/36* (2013.01); *B65D 2571/0066* (2013.01); *B65D 2571/00141* (2013.01); *B65D 2571/00462* (2013.01); *B65D 2571/00469* (2013.01); *B65D 2571/00518* (2013.01); *B65D 2571/00543* (2013.01); *B65D 2571/00728* (2013.01)

(58) Field of Classification Search
USPC ..... 206/427
See application file for complete search history.

(56) References Cited

U.S. PATENT DOCUMENTS

| | | | |
|---|---|---|---|
| 2,810,506 | A | 10/1957 | Kessler |
| 2,842,304 | A | 7/1958 | Ringler |
| 2,868,433 | A | 1/1959 | Anderson, Jr. |
| 2,955,739 | A | 10/1960 | Collura |
| 3,076,591 | A | 2/1963 | Nute et al. |
| 3,112,856 | A | 12/1963 | MacIntosh et al. |
| 3,300,119 | A | 1/1967 | Chaussadas |
| 3,904,036 | A | 9/1975 | Forrer |
| 4,036,423 | A | 7/1977 | Gordon |
| 4,328,923 | A | 5/1982 | Graser |
| 4,378,905 | A | 4/1983 | Roccaforte |
| 4,470,503 | A | 9/1984 | Stone |
| 4,482,090 | A | 11/1984 | Milliens |
| 4,498,619 | A | 2/1985 | Roccaforte |
| 4,546,914 | A | 10/1985 | Roccaforte |
| 4,588,084 | A | 5/1986 | Holley, Jr. |
| 4,747,534 | A | 5/1988 | Marie |
| 5,020,337 | A | 6/1991 | Krieg |
| 5,197,598 | A | 3/1993 | Stout et al. |
| 5,240,174 | A | 8/1993 | Wenniger |
| 5,292,058 | A | 3/1994 | Zoss et al. |
| 5,297,725 | A | 3/1994 | Sutherland |
| 5,328,081 | A | 7/1994 | Saulas |
| 5,333,734 | A | 8/1994 | Stout et al. |
| 5,385,234 | A | 1/1995 | Stout et al. |
| 5,482,203 | A | 1/1996 | Stout |
| 5,495,727 | A | 3/1996 | Strong et al. |
| 5,582,343 | A | 12/1996 | Dalvey |
| 5,639,017 | A | 6/1997 | Fogle |
| 5,738,273 | A | 4/1998 | Auclair |
| 5,796,778 | A | 8/1998 | Kurker |
| 5,873,515 | A | 2/1999 | Dunn et al. |
| 5,878,946 | A | 3/1999 | Frerot et al. |
| 5,915,546 | A | 6/1999 | Harrelson |
| 5,992,733 | A | 11/1999 | Gomes |
| 6,019,276 | A | 2/2000 | Auclair |
| 6,065,590 | A | 5/2000 | Spivey |
| 6,131,803 | A | 10/2000 | Oliff et al. |
| 6,164,526 | A | 12/2000 | Dalvey |
| 6,260,755 | B1 | 7/2001 | Bates et al. |
| 6,425,520 | B1 | 7/2002 | Peterson |
| 6,631,803 | B2 | 10/2003 | Rhodes et al. |
| 6,899,221 | B2 | 5/2005 | Skolik et al. |
| 6,905,066 | B2 | 6/2005 | Holley et al. |
| 6,926,193 | B2 | 8/2005 | Smalley |
| 7,007,836 | B2 | 3/2006 | Smalley |
| 7,748,603 | B2 | 7/2010 | Fogle et al. |
| 8,191,761 | B2 | 6/2012 | Brand |
| 8,740,051 | B2 | 6/2014 | Gonzalez |
| 2001/0017314 | A1 | 8/2001 | Boukredine et al. |
| 2003/0015579 | A1 | 1/2003 | LeBras et al. |
| 2005/0247767 | A1 | 11/2005 | Smalley |
| 2006/0273143 | A1 | 12/2006 | Finch |
| 2007/0051781 | A1 | 3/2007 | Holley, Jr. |
| 2007/0095882 | A1 | 5/2007 | Holley, Jr. |
| 2007/0164091 | A1 | 7/2007 | Fogle et al. |
| 2007/0181658 | A1* | 8/2007 | Sutherland ..... B65D 71/36 229/243 |
| 2007/0272184 | A1 | 11/2007 | Rommel |
| 2008/0048014 | A1 | 2/2008 | Bates |
| 2008/0099544 | A1 | 5/2008 | Skolik |
| 2012/0012600 | A1* | 1/2012 | Gonzalez ..... B65D 71/36 220/752 |
| 2012/0211552 | A1 | 8/2012 | Kastanek et al. |
| 2014/0238882 | A1 | 8/2014 | Requena |
| 2017/0008662 | A1* | 1/2017 | Loftin ..... B65D 5/46024 |

FOREIGN PATENT DOCUMENTS

| | | |
|---|---|---|
| DE | 20 2004 018 649 | 4/2005 |
| EP | 0 754 631 | 1/1997 |
| FR | 2 481 231 | 10/1981 |
| GB | 2 206 565 | 1/1989 |
| GB | 2 422 819 A | 8/2006 |
| WO | WO 95/05324 | 2/1995 |
| WO | WO 96/01770 | 1/1996 |
| WO | WO 96/20881 | 7/1996 |
| WO | WO 96/21603 | 7/1996 |
| WO | WO 96/27538 | 9/1996 |
| WO | WO 97/44253 | 11/1997 |
| WO | WO 99/28207 | 6/1999 |
| WO | WO 00/20288 | 4/2000 |
| WO | WO 02/36440 | 5/2002 |
| WO | WO 2006/084009 | 8/2006 |
| WO | WO 2007/089282 | 8/2007 |
| WO | WO 2010/014862 A1 | 2/2010 |

* cited by examiner

CARTON WITH HANDLE

CROSS-REFERENCE TO RELATED APPLICATION

The present application claims the benefit of U.S. Provisional Patent Application No. 62/256,967 filed on Nov. 18, 2015.

INCORPORATION BY REFERENCE

The disclosure of U.S. Provisional Patent Application No. 62/256,967, filed on Nov. 18, 2015, is hereby incorporated by reference for all purposes as if presented herein it its entirety.

BACKGROUND OF THE DISCLOSURE

The present disclosure generally relates to cartons for holding containers. More specifically, the present disclosure relates to a carton having a handle.

SUMMARY OF THE DISCLOSURE

According to one aspect of the disclosure, a carton for containing a plurality of articles is disclosed. The carton comprises a plurality of panels that extends at least partially around an interior of the carton. The plurality of panels comprises a first top panel, a second top panel, a bottom panel, a first side panel, and a second side panel. The first top panel and the second top panel are at least partially overlapped to form a top wall of the carton. A plurality of end flaps is foldably connected to a respective panel of the plurality of panels for at least partially closing an end of the carton. The plurality of end flaps comprises a first top end flap foldably connected to the first top panel and a second top end flap foldably connected to the second top panel. A handle extends in at least the top wall of the carton and comprises a first handle portion in the first top panel, a second handle portion in the second top panel, and a third handle portion in the closed end. The third handle portion is at least partially formed by a line of weakening in the second top end flap. The first handle portion extends into the first top end flap. The second handle portion is spaced apart from the third handle portion. The first handle portion is connected to the second handle portion and the third handle portion.

According to another aspect of the disclosure, a blank for forming a carton for containing a plurality of articles is disclosed. The blank comprises a plurality of panels comprising a first top panel, a second top panel, a bottom panel, a first side panel, and a second side panel. The first top panel and the second top panel are for being at least partially overlapped to form a top wall of the carton formed from the blank. A plurality of end flaps are foldably connected to a respective panel of the plurality of panels for at least partially closing an end of the carton formed from the blank. The plurality of end flaps comprise a first top end flap foldably connected to the first top panel and a second top end flap foldably connected to the second top panel. Handle features are for forming a handle extending in at least the top wall of the carton. The handle comprising a first handle portion in the first top panel, a second handle portion in the second top panel, and a third handle portion at least partially formed by a line of weakening in the second top end flap. The first handle portion extends into the first top end flap, the second handle portion is spaced apart from the third handle portion, and the first handle portion is for being connected to the second handle portion and the third handle portion in the carton formed from the blank.

According to another aspect of the disclosure, a method of forming a carton for containing a plurality of articles is disclosed. The method comprises obtaining a blank having a plurality of panels comprising a first top panel, a second top panel, a bottom panel, a first side panel, and a second side panel, a plurality of end flaps foldably connected to a respective panel of the plurality of panels. The plurality of end flaps comprise a first top end flap foldably connected to the first top panel and a second top end flap foldably connected to the second top panel. Handle features are for forming a handle. The handle comprising a first handle portion in the first top panel, a second handle portion in the second top panel, and a third handle portion at least partially formed by a line of weakening in the second top end flap. The method comprises folding the plurality of panels to at least partially form an interior of the carton. The folding the plurality of panels comprising at least partially overlapping the first top panel and the second top panel to form a top wall. The method comprises forming the handle from the first handle portion, second handle portion, and third handle portion. The first handle portion extends into the first top end flap, the second handle portion being spaced apart from the third handle portion, and the first handle portion is connected to the second handle portion and the third handle portion.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
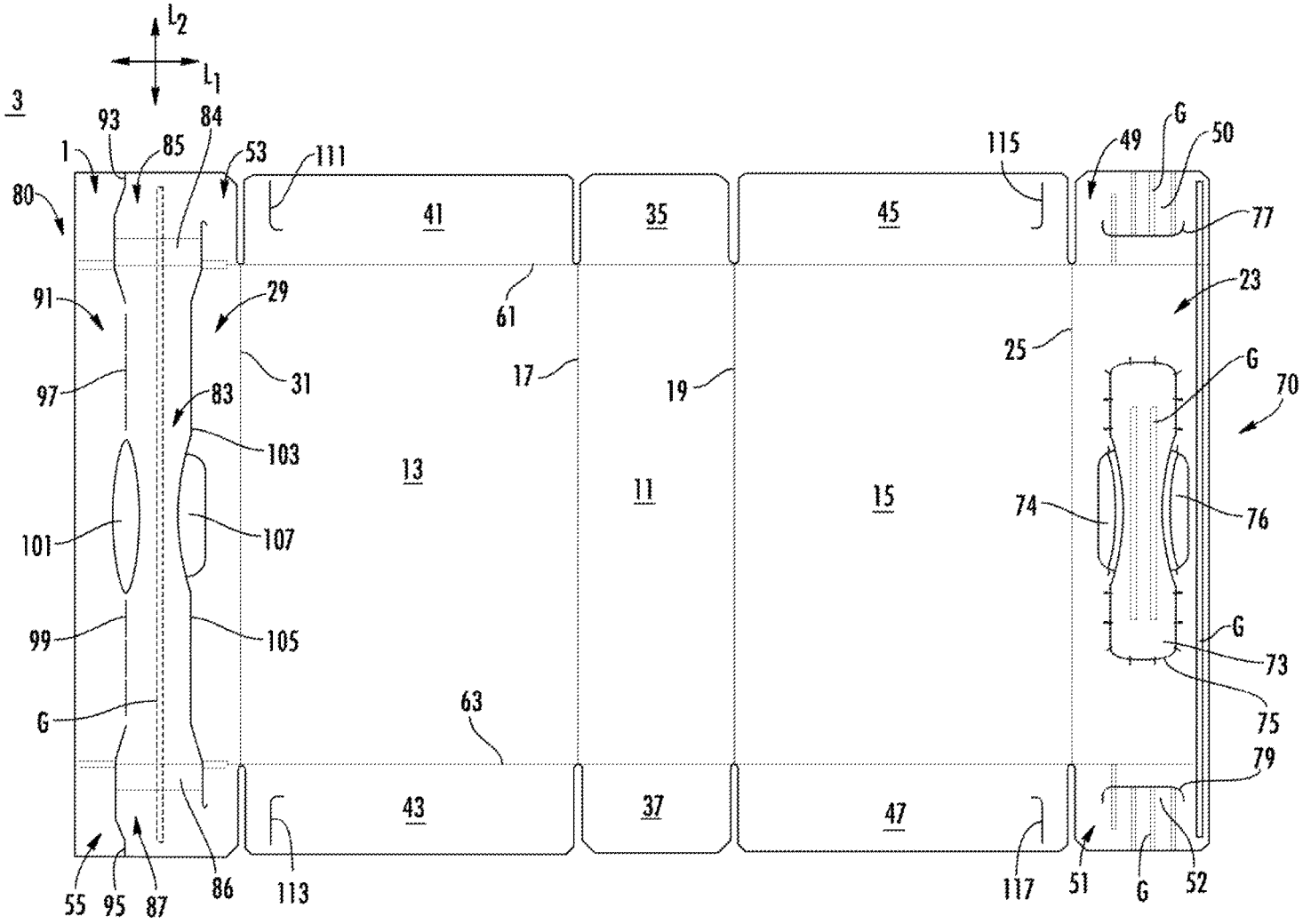
FIG. 1 is a plan view of an exterior side of a blank for forming a carton according to one embodiment of the disclosure.

FIG. 1 is a plan view of the exterior side 1 of a blank, generally indicated at 3, used to form a carton 5 (FIG. 4) according to a first exemplary embodiment of the disclosure. The carton 5 can be used to house a plurality of articles such as containers C. The carton 5 has a handle, generally indicated at 7 (FIGS. 4-6), formed in a top wall 6 of the carton 5 for grasping and carrying the carton 5. In one illustrated embodiment, the carton 5 is sized to house twenty-four containers in one layer in a 4×6 arrangement, but it is understood that the carton may be sized and shaped to hold containers of a different or same quantity in a single layer, more than one layer, and/or in different row/column arrangements (e.g., 1×6, 3×6, 3×5×2, 2×6, 5×6, 2×6×2, 3×4×2, 2×9, etc.). In the illustrated embodiment, the containers C are cans, but other types of containers (e.g., bottles) can be used in the carton 5 without departing from the disclosure.

The blank 3 has a longitudinal axis L1 and a lateral axis L2. The blank 3 comprises a bottom panel 11 foldably connected to first and second side panels 13, 15 at respective lateral fold lines 17, 19, a second top panel 23 foldably connected to the first side panel 15 at a lateral fold line 25, and a first top panel 29 foldably connected to the first side panel 13 at a lateral fold line 31. The first and second top panels 23, 29 will at least partially overlap in the erected carton 5 to form the top wall 6, as described further herein.

The bottom panel 11 is foldably connected to a first bottom end flap 35 and a second bottom end flap 37. The first side panel 13 is foldably connected to a first side end flap 41 and a second side end flap 43. The second side panel 15 is foldably connected to a first side end flap 45 and a second side end flap 47. The second top panel 23 is foldably connected to a first top end flap 49 and a second top end flap 51. The first top panel 29 is foldably connected to a first top end flap 53 and a second top end flap 55. The end flaps 35, 41, 45, 49, 53 extend along a first marginal area of the blank 3, and are foldably connected at a first longitudinal fold line 61. The end flaps 37, 43, 47, 51, 55 extend along a second marginal area of the blank 3, and are foldably connected at a second longitudinal fold line 63. The longitudinal fold lines 61, 63 may be, for example, substantially straight, offset, or oblique at one or more locations to account for blank thickness or for other factors. When the carton 5 is erected, the end flaps 35, 41, 45, 49, 53 at least partially close a first end 67 (FIG. 4) of the carton 5, and the end flaps 37, 43, 47, 51, 55 close a second end 69 (FIG. 4) of the carton 5. In accordance with an alternative embodiment of the present disclosure, different flap arrangements can be used for closing the ends 67, 69 of the carton 5.

In the illustrated embodiment, the blank 3 includes first handle features 70 that comprise a central handle portion 73 that forms a second handle portion in the second top panel 23 defined by a tear line 75 in the second top panel 23. The central handle portion 73, as shown, may extend between openings 74, 76 in the first top panel 73. In this regard, the tear line 75 may extend along portions of central handle portion 73 that are not bounded by openings 74, 76.

As shown, the blank includes handle features in the end flaps 49, 51 that may each include respective cuts 77, 79 that are generally U-shaped in configuration. The cuts 77, 79 could be tear lines such as cuts including nicks without departing from the disclosure. In embodiments, one or both of cuts 77, 79 could have a different configuration, for example, a straight cut, an angled cut, or a curved cut. Cut 77 of end flap 49 at least partially defines a relief portion 50 that is moveable relative to the remainder of end flap 49, and cut 79 of end flap 51 at least partially defines a relief portion 52 that is movable relative to the remainder of end flap 51, as described further herein.

In one embodiment, and as shown, the blank 3 includes second handle features 80 that comprises a handle portion 83 forming a first handle portion in the first top panel 29 and that has end portions 85, 87 that extend into respective end flaps 53, 55 such that the handle portion 83 comprises a portion of the first top panel 29 and a portion of the end flaps 53, 55.

A handle reinforcement flap 91 is foldably connected to the handle portion 83 at respective fold lines 93, 95 and is separable from the handle portion 83 along cut or tear lines 97, 99 extending from an opening 101 along the handle portion 83 in the first top panel 29 to respective fold lines 93, 95. In embodiments, cut or tear lines 97, 99 may also be fold lines. A portion of fold lines 93, 95 may be obliquely-disposed with respect to respective cut or tear lines 97, 99 such that a widened portions 84, 86 of handle portion 83 are present along respective end flaps 53, 55.

The handle portion 83 is also defined by cuts or tears 103, 105 extending in opposite directions along axis L2 from an opening 107 in the first top panel 29 and into respective end flaps 53, 55.

In one embodiment, and as shown, the features of handle 7 (FIG. 4) further include cuts or tears 111, 113, 115, 117 in respective end flaps 41, 43, 45, 47. As shown, cuts or tears 111, 113, 115, 117 may have a substantially J-shaped configuration, with a curved portion of the respective cuts or tears 111, 115, and 113, 117 disposed nearest the respective fold lines 61, 63.

An exemplary method of erecting the carton 5 from the blank 3 is discussed in detail below and shown in the FIGS. 2-6. At various stages of the erecting process, glue or other adhesive G can be applied to various portions of the blank 3. While adhesive G has been illustrated disposed as strips along portions of handle portion 83 and end flaps 49, 51, it will be understood that adhesive G may be disposed differently upon blank 3 to facilitate assembly of carton 5.

Figure 2:
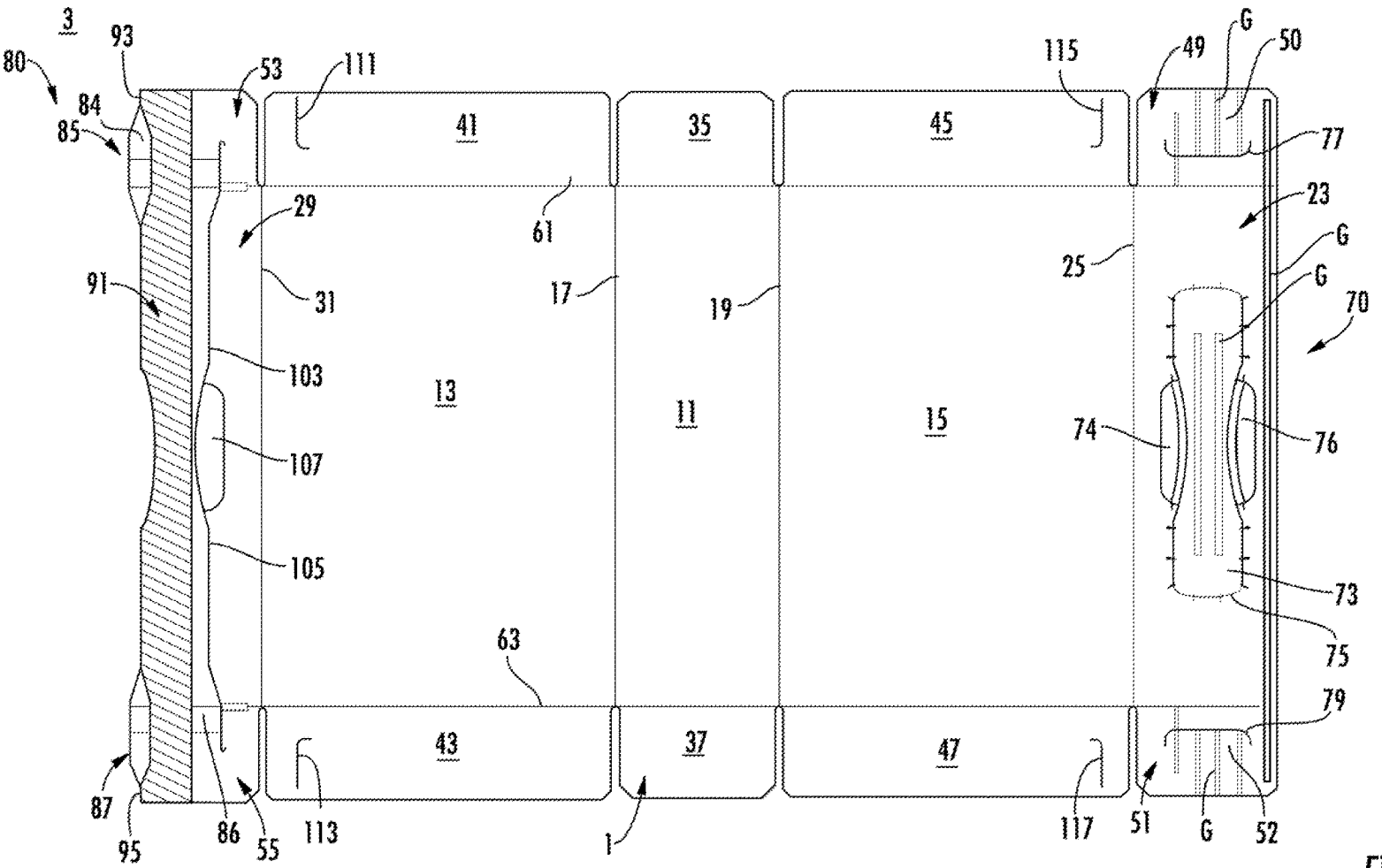
FIG. 2 is a plan view of the blank of FIG. 1 in a partially-folded configuration.

Still referring to FIG. 1, and referring additionally to FIG. 2, the handle reinforcement flap 91, as shown, is folded about fold lines 93, 95 and positioned to be in face-to-face contact and adhered to the handle portion 83. In this regard, the reinforcement flap 91 may be separated from handle portion 83 along cut or tear lines 97, 99 or cut or tear lines 97, 99 may function as fold lines.

Figure 3:
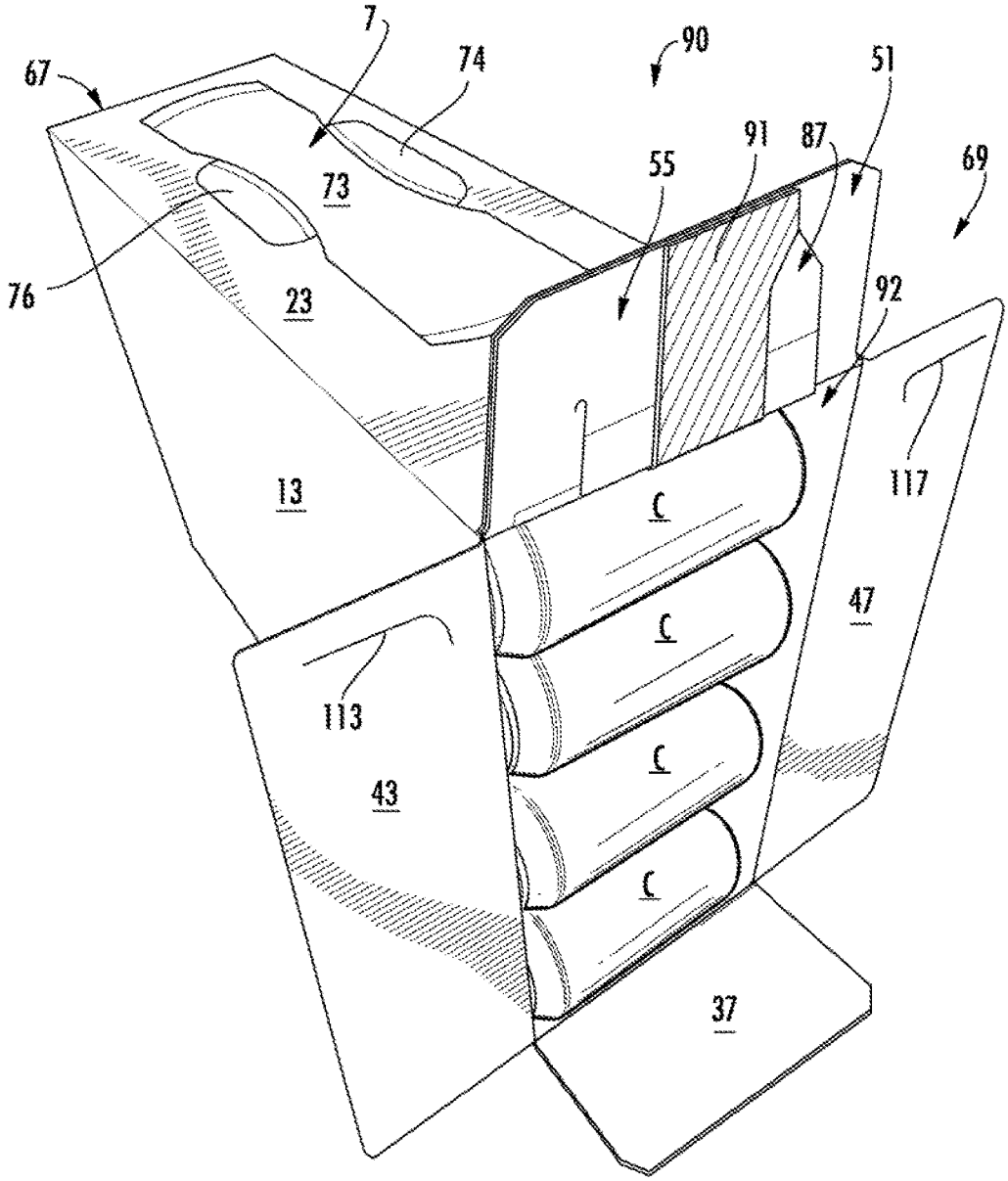
FIG. 3 is a perspective view of the blank of FIG. 1 in a partially-folded configuration.

Referring to FIGS. 1-3, the blank 3 is folded about fold lines 17, 19, 25, 31 so that the second panel 23 overlaps the first top panel 29 to form a generally open-ended sleeve 90 such that an interior 92 of the carton 5 is accessible. In such configuration, the top wall is formed by the overlapped top panels 23, 29, and the central handle portion 73 overlaps the handle portion 83 and the reinforcement flap 91 and is adhesively attached thereto, for example, through adhesive G. In this regard, the end flaps 49, 51 overlap the respective end flaps 53, 55 and are adhesively attached thereto, as described further herein, such that the relief portions 50, 52 of the respective end flaps 53, 55 are adhered to the portions 84, 86 of the handle portion 83 in respective end flaps 53, 55. Articles such as beverage containers C can be inserted into the open-ended sleeve 90 prior to closing the ends 67, 69. Alternatively, one of the ends 67, 69 can be closed prior to inserting the beverage containers C into the carton 5.

Figure 4:
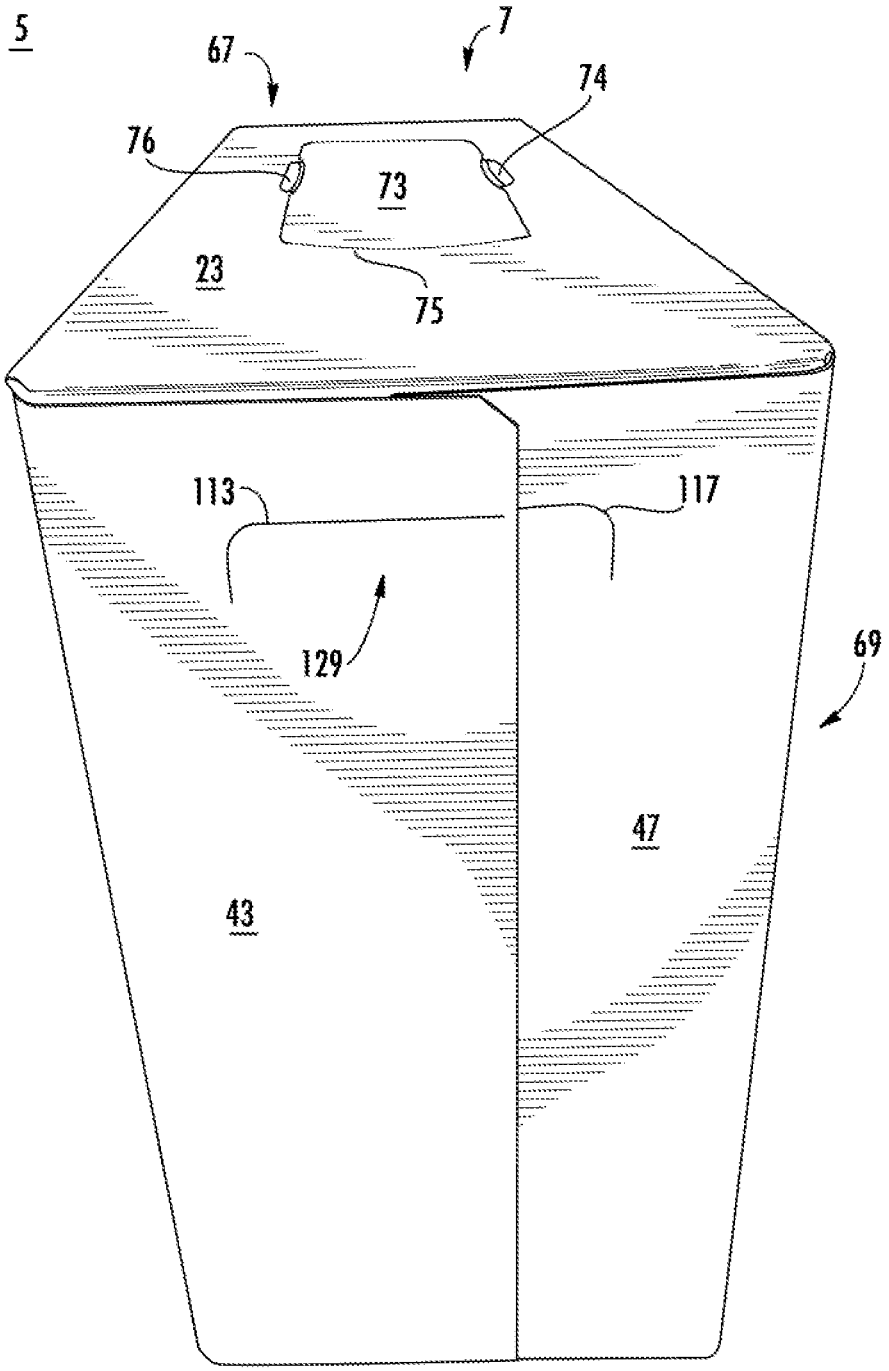
FIG. 4 is a perspective view of a carton formed from the blank of FIG. 1 according to one embodiment of the disclosure.

Still referring to FIGS. 1 and 2, and referring additionally to FIG. 4, the assembled carton 5 is illustrated, with overlapped end flaps 49, 53 folded downwardly at fold line 61, overlapped end flaps 51, 55 folded downwardly at fold line 63, and end flaps 35, 37 folded upwardly at respective fold lines 61, 63. End flaps 41 and 45 are overlapped over end flaps 49, 53, and 35 to close the first end 67 of the carton 5, and end flaps 43 and 47 are overlapped over end flaps 51, 55, 37 to close the second end 69 of the carton 5. In such closed configuration, the J-shaped cuts 111, 115 may be aligned and positioned to cooperate to form a U-shaped cut in the first closed end 67 that defines a relief portion of the first closed end 67 that is in alignment with and overlaps the relief portion 50 in the end flap 49. The cuts 111, 115 in end flaps 41, 45 overlap and align with the cut 77 in the end flap 49 in the closed end 67. Similarly, the J-shaped cuts 113, 117 may be aligned and positioned to cooperate to form a U-shaped cut 127 in the second closed end 69 that defines a relief portion 129 of the second closed end 69 that overlaps and is in alignment with the relief portion 52 in the end flap 51. The cuts 113, 117 in the end flaps 43, 47 overlap and align with the cut 79 in the end flap 51 in the closed end 69. The closed ends 67, 69 could be otherwise formed and could have other features without departing from the disclosure.

The assembled handle 7, as shown, is formed by the attachment of the central handle portion 73 of the second top panel 23 to the handle portion 83 and the folded handle reinforcement flap 91 of the first top panel 29. As described above, the relief portion 50 of the end flap 49 defined by the cut 77 is adhered to the portion 84 of the handle portion 83 along the end flap 49, and the relief portion 52 of the end flap 51 defined by the cut 79 is adhered to the portion 86 of the handle portion 83 along the end flap 51. In this regard, the handle 7 includes a strap handle portion 121 having a three-ply configuration in the overlapped top panels 22, 29 formed by the central handle portion 73, the handle portion 83, and the handle reinforcement flap 91.

In this regard, in the closed ends 67, 69 the handle 7 is reinforced by the overlapped portions of the handle features. For example, the handle 7 includes portions of the overlapped end flaps 49, 53 forming a three-ply configuration formed by the relief portion 50 of end flap 49 defined by the cut 77 and the portions of handle portion 83 and reinforcing flap 91 along the end flap 53. The handle 7 has a four-ply configuration where the relief portion 50 and portions of handle portion 83 and reinforcing flap 91 are overlapped by only one of the side end flaps 41, 45 in the area adjacent respective cuts 111, 115. The handle has a five-play configuration in the closed end 67 where the marginal portions of the side end flaps are overlapped. Similarly, the closed end 69 has a four-ply configuration where the end flaps 43, 47 are not overlapped and a five-ply configuration where the end flaps 43, 47 overlap at the relief portion 129 formed in the closed end 69. Such reinforced configuration of the handle 7 allows the handle to be used on large cartons 5 such as cartons containing 24 containers without tearing or failure of the handle. The handle 7 can have other features or the features shown herein can be otherwise shaped, arranged, configured, and/or omitted without departing from the disclosure.

Figure 5:
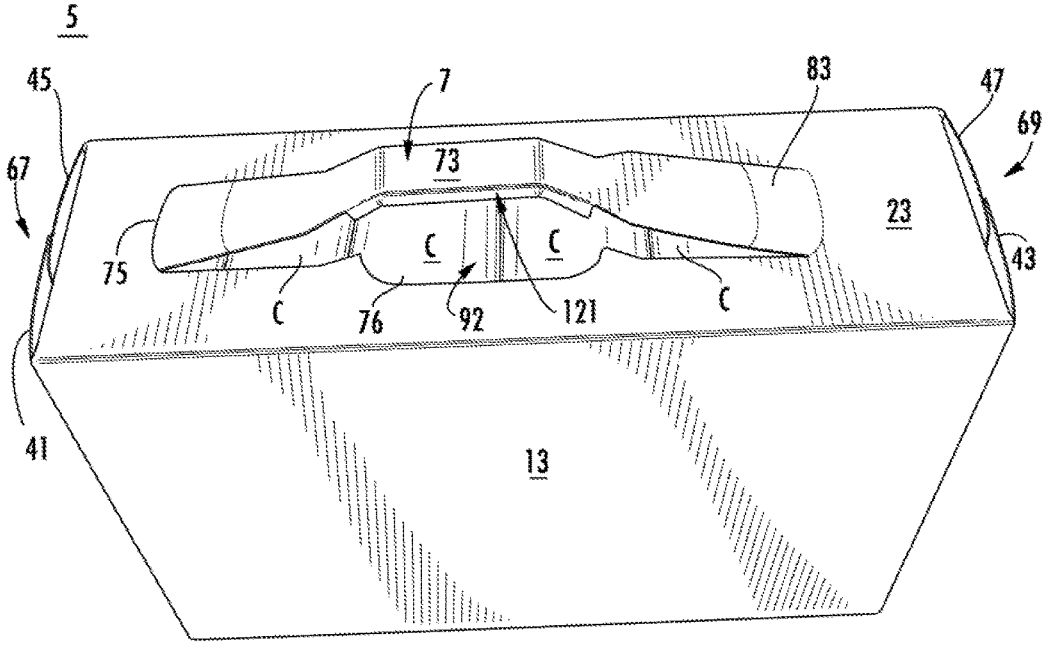
FIG. 5 is a perspective view of the carton of FIG. 4 with a handle of the carton in an activated configuration.

Still referring to FIGS. 1 and 2, and referring additionally to FIG. 5, the handle 7 can be activated by grasping the handle portion 121 in the overlapped top panels 23, 29. The aligned openings 74, 76, and the opening 107 (aligned with opening 76) provide access along the handle portion 121 for a user to insert a portion of his or her hand at least partially into interior 92 of carton 5 to grasp handle portion 121. Lifting of the handle portion 121 may cause tearing and separation of the handle portion 83 from the first top panel 29 and end flaps 53, 55 along tear lines 97, 99, 103, 105 so that the handle portion 121 can be lifted upwardly in an outward direction relative to the remainder of top panels 23, 29 and the interior 92 of the carton 5.

Figure 6:
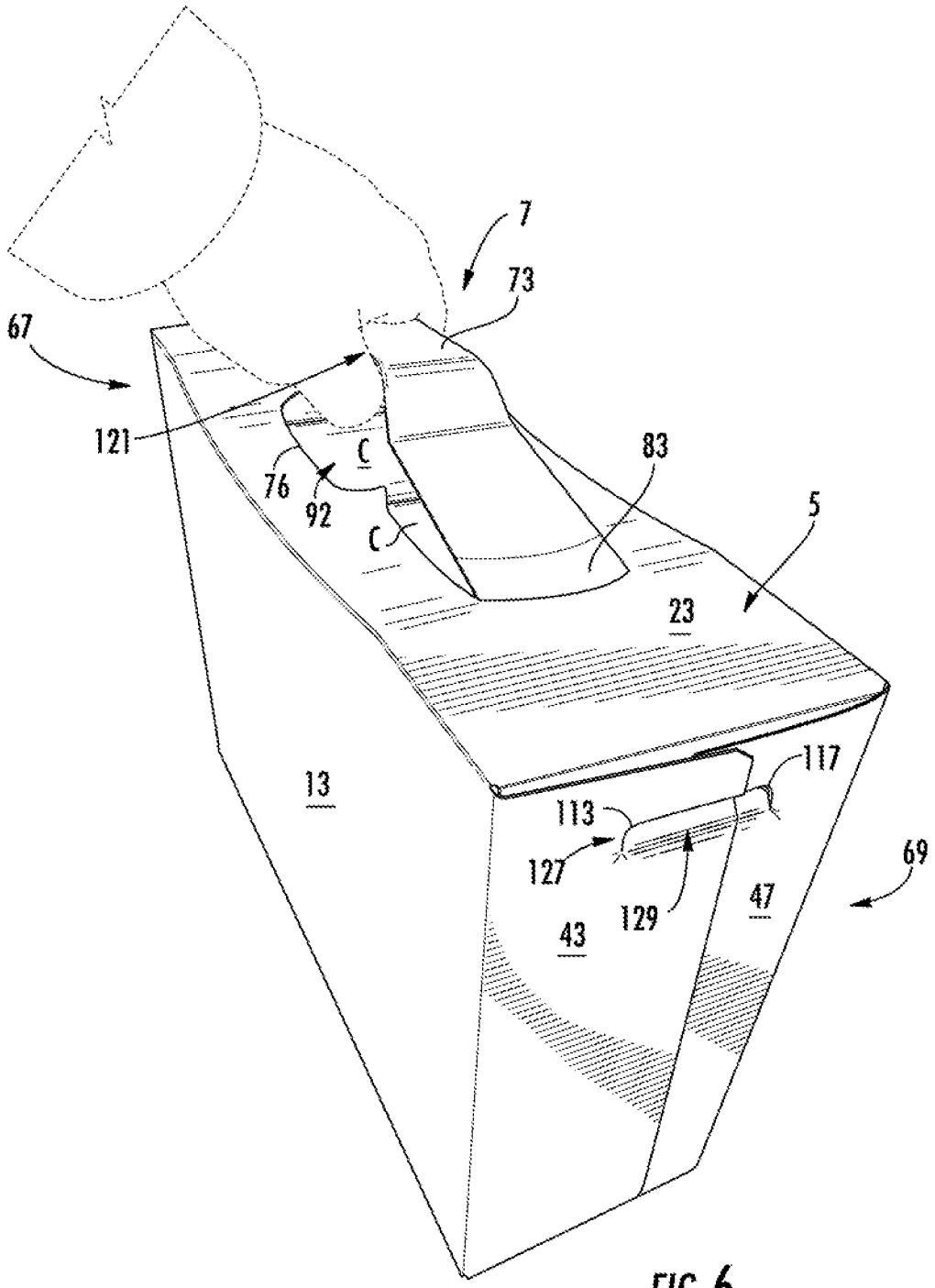
FIG. 6 is a perspective view of the carton of FIG. 4 with a handle of the carton in an activated configuration.

Referring to FIGS. 1, 2, and 6, and as described above, the handle portion 83 and handle reinforcement flap 91 connect the central handle portion 73 and the overlapped end flaps 49, 53 and 51, 55, respectively, at the ends 67, 69 to increase strength of the handle 7 and distribute lifting forces in the top and ends of the carton 5. For example, the three-ply configuration of the handle portion 121 provides enhanced durability that is resistant, for example, to tearing or other weakening such as through contact with fluid. Further, the three-ply, four-ply, and five-play configuration of portions of the handle portion 121 provides a substantial grip that can provide better comfort and durability for a user carrying carton 5.

Additionally, the relief portion 50 defined by the cut 77 of end flap 49 and the relief portion 52 defined by the cut 79 of end flap 51 provide relief for the handle 7. Because the handle portion 83 is adhered to the relief portions 50, 52 as described above, upward movement of the handle 7 causes the relief portions 50, 52 to flex inwardly toward the interior 92 of the carton 5. Such inward flexion of the portions 50, 52 serves to reduce stresses on both the handle 7 and the ends 67, 69 of the carton 5 to reduce the possibility of tearing. Additionally, such inward flexion of the relief portions 50, 52 serves to provide the handle 7 with an enhanced degree of movement relative to the remainder of carton 5, for example, such that the carton 5 can be jostled or subjected to incidental movement without causing undue stress or strain on either the handle 7 or the hand of a user carrying carton 5. Because the relief portions 125, 129 of the respective ends 67, 69 of the carton 5 formed by respective cuts 111, 115 and 113, 117 are secured to the respective relief portions 50, 52, it will be understood that relief portions 125, 129 may also flex inwardly toward the interior 92 of the carton 5 upon movement of the handle 7 to provide relief as described above.

In one embodiment, the features of the blank 3 that form the handle 7 include a first handle portion 83, a second handle portion 73, a third handle portion comprising the overlapped cuts 77, 111, 115 and relief portion 50 that is overlapped by portions of the side end flaps 41, 45 in the closed end 67 of the carton, and a fourth handle portion comprising the overlapped cuts 79, 113, 117 and relief portion 52 that is overlapped by portions of the side end flaps 43, 47 adjacent the cuts 113, 117 to form the relief portion 129, in the closed end 69 of the carton. The second handle portion 73 is spaced apart from the third handle portion and the fourth handle portion and the first handle portion 83 is connected to the second handle portion 73, the third handle portion, and the fourth handle portion to provide strength and reinforcement of the handle 7.

Any of the features of the various embodiments of the disclosure can be combined with, replaced by, or otherwise configured with other features of other embodiments of the disclosure without departing from the scope of this disclosure. Further, it is noted that the handle features and stress-relief areas of the various embodiments can be incorporated into a carton having any carton style or panel configuration. The carton styles and panel configurations described above are included by way of example.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels or flaps in place.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising a first top panel, a second top panel, a bottom panel, a first side panel, and a second side panel, the first top panel and the second top panel are at least partially overlapped to form a top wall of the carton;

a plurality of end flaps foldably connected to a respective panel of the plurality of panels for at least partially closing an end of the carton, the plurality of end flaps comprises a first top end flap foldably connected to the first top panel, a second top end flap foldably connected to the second top panel, and at least one side end flap foldably connected to a respective one of the first side panel and the second side panel; and a handle extending in at least the top wall of the carton and comprising a first handle portion in the first top panel, a second handle portion in the second top panel, and a third handle portion in the closed end, the third handle portion being at least partially formed by a first line of weakening in the second top end flap and a second line of weakening in the at least one side end flap, the first handle portion extending into the first top end flap, the second handle portion being spaced apart from the first line of weakening, the first handle portion being connected to the second handle portion and the third handle portion.

2. The carton of claim 1, wherein the first line of weakening and the second line of weakening are at least partially overlapped.

3. The carton of claim 2, wherein the at least one side end flap is a first side end flap foldably connected to the first side panel, the second line of weakening is in the first side end flap, and the plurality of end flaps comprises a second side end flap foldably connected to the second side panel, the third handle portion comprises a third line of weakening in the second side end flap.

4. The carton of claim 3, wherein the first line of weakening and the third line of weakening are at least partially overlapped.

5. The carton of claim 2, wherein the first line of weakening is generally U-shaped and the second line of weakening is generally J-shaped.

6. The carton of claim 1, wherein activation of the handle causes the first handle portion and the second handle portion to move in an outward direction away from the interior of the carton and the third handle portion moves in an inward direction towards the interior of the carton.

7. The carton of claim 1, further comprising a handle reinforcement flap foldably connected to the first top panel.

8. The carton of claim 7, wherein the handle reinforcement flap is at least partially separable from the first top panel along a tear line, the tear line defines at least a portion of the first handle portion.

9. The carton of claim 7, wherein the handle reinforcement flap is in face-to-face contact with the first handle portion.

10. The carton of claim 9, wherein a portion of at least one of the first handle portion and the handle reinforcement flap is in face-to-face contact with the third handle portion.

11. The carton of claim 10, wherein a portion of the at least one of the first handle portion and the handle reinforcement flap is in face-to-face contact with the second handle portion.

12. The carton of claim 1, wherein the first handle portion is at least partially separable from the first top panel, the second handle portion is at least partially separable from the second top panel, and the third handle portion is at least partially separable from the second top end flap.

13. A carton for containing a plurality of articles, the carton comprising:

a plurality of panels that extends at least partially around an interior of the carton, the plurality of panels comprising a first top panel, a second top panel, a bottom panel, a first side panel, and a second side panel, the first top panel and the second top panel are at least partially overlapped to form a top wall of the carton;

a first plurality of end flaps foldably connected to a respective panel of the plurality of panels for at least partially closing a first end of the carton, the first plurality of end flaps comprises a first top end flap foldably connected to the first top panel and a second top end flap foldably connected to the second top panel;

a second plurality of end flaps foldably connected to a respective panel of the plurality of panels for at least partially closing a second end of the carton, the second plurality of end flaps comprises a third top end flap foldably connected to the first top panel and a fourth top end flap foldably connected to the second top panel; and a handle extending in at least the top wall of the carton and comprising a first handle portion in the first top panel, a second handle portion in the second top panel, a third handle portion in the first closed end, and a fourth handle portion in the second closed end, the third handle portion being at least partially formed by a first line of weakening in the second top end flap and the fourth handle portion is at least partially formed by a second line of weakening in the fourth top end flap, the first handle portion extending into the first top end flap, the second handle portion being spaced apart from the first line of weakening, and the first handle portion being connected to the second handle portion and the third handle portion.

14. The carton of claim 13, wherein the first handle portion extends into the third top end flap, the second handle portion is spaced apart from the second line of weakening at least partially forming the fourth handle portion, and the first handle portion is connected to the fourth handle portion.

15. The carton of claim 13, wherein the second plurality of end flaps comprises at least one side end flap foldably connected to a respective one of the first side panel and the second side panel, the fourth handle portion comprises a third line of weakening in the at least one side end flap.

16. A blank for forming a carton for containing a plurality of articles, the blank comprising:

a plurality of panels comprising a first top panel, a second top panel, a bottom panel, a first side panel, and a second side panel, the first top panel and the second top panel are for being at least partially overlapped to form a top wall of the carton formed from the blank;

a plurality of end flaps foldably connected to a respective panel of the plurality of panels for at least partially closing an end of the carton formed from the blank, the plurality of end flaps comprises a first top end flap foldably connected to the first top panel, a second top end flap foldably connected to the second top panel, and at least one side end flap foldably connected to a respective one of the first side panel and the second side panel; and handle features for forming a handle extending in at least the top wall of the carton, the handle comprising a first handle portion in the first top panel, a second handle portion in the second top panel, and a third handle portion at least partially formed by a first line of weakening in the second top end flap and a second line of weakening in the at least one side end flap, the first handle portion extending into the first top end flap, the second handle portion being spaced apart from the first line of weakening, the first handle portion is for being connected to the second handle portion and the third handle portion in the carton formed from the blank, and the first line of weakening and the second line of weakening are for being at least partially overlapped in the carton formed from the blank.

17. The blank of claim 16, wherein the at least one side end flap is a first side end flap foldably connected to the first side panel, the second line of weakening is in the first side end flap, and the plurality of end flaps comprises a second side end flap foldably connected to the second side panel, the third handle portion comprises a third line of weakening in the second side end flap, the first line of weakening and the third line of weakening are for being at least partially overlapped in the carton formed from the blank.

18. The blank of claim 16, wherein the first line of weakening is generally U-shaped and the second line of weakening is generally J-shaped.

19. The blank of claim 16, wherein the handle features further comprise a handle reinforcement flap foldably connected to the first top panel, the handle reinforcement flap is at least partially separable from the first top panel at a tear line, the tear line defines at least a portion of the first handle portion.

20. The blank of claim 19, wherein the handle reinforcement flap is in face-to-face contact with the first handle portion.

21. The blank of claim 20, wherein a portion of at least one of the first handle portion and the handle reinforcement flap is in face-to-face contact with the third handle portion.

22. The blank of claim 20, wherein a portion of the at least one of the first handle portion and the handle reinforcement flap is in face-to-face contact with the second handle portion.

23. The blank of claim 16, wherein the first handle portion is at least partially separable from the first top panel, the second handle portion is at least partially separable from the second top panel, and the third handle portion is at least partially separable from the second top end flap.

24. A blank for forming a carton for containing a plurality of articles, the blank comprising:

a plurality of panels comprising a first top panel, a second top panel, a bottom panel, a first side panel, and a second side panel, the first top panel and the second top panel are for being at least partially overlapped to form a top wall of the carton formed from the blank;

a plurality of first end flaps foldably connected to a respective panel of the plurality of panels for at least partially closing a first end of the carton formed from the blank, the first plurality of end flaps comprises a first top end flap foldably connected to the first top panel and a second top end flap foldably connected to the second top panel;

a second plurality of end flaps foldably connected to a respective panel of the plurality of panels for at least partially closing a second end of the carton formed from the blank, the second plurality of end flaps comprises a third top end flap foldably connected to the first top panel and a fourth top end flap foldably connected to the second top panel; and handle features for forming a handle extending in at least the top wall of the carton, the handle comprising a first handle portion in the first top panel, a second handle portion in the second top panel, a third handle portion at least partially formed by a first line of weakening in the second top end flap, and a fourth handle portion at least partially formed by a second line of weakening in the fourth top end flap, the first handle portion extending into the first top end flap, the second handle portion being spaced apart from the first line of weakening, the first handle portion is for being connected to the second handle portion and the third handle portion in the carton formed from the blank.

25. The blank of claim 24, wherein the first handle portion extends into the third top end flap, the second handle portion is spaced apart from the second line of weakening at least partially forming the fourth handle portion, and the first handle portion is connected to the fourth handle portion in the carton formed from the blank.

26. The blank of claim 24, wherein the second plurality of end flaps comprises at least one side end flap foldably connected to a respective one of the first side panel and the second side panel, the fourth handle portion comprises a third line of weakening in the at least one side end flap.

27. A method of forming a carton for containing a plurality of articles, the method comprising:

obtaining a blank having a plurality of panels comprising a first top panel, a second top panel, a bottom panel, a first side panel, and a second side panel, a plurality of end flaps foldably connected to a respective panel of the plurality of panels, the plurality of end flaps comprise a first top end flap foldably connected to the first top panel, a second top end flap foldably connected to the second top panel, and at least one side end flap foldably connected to a respective one of the first side panel and the second side panel, and handle features for Ruining a handle, the handle comprising a first handle portion in the first top panel, a second handle portion in the second top panel, and a third handle portion at least partially forming by a first line of weakening in the second top end flap and a second line of weakening in the at least one side end flap;

folding the plurality of panels to at least partially form an interior of the carton, the folding the plurality of panels comprising at least partially overlapping the first top panel and the second top panel to form a top wall; and forming the handle from the first handle portion, the second handle portion, and the third handle portion, the first handle portion extending into the first top end flap, the second handle portion being spaced apart from the first line of weakening at least partially forming the third handle portion, and the first handle portion is connected to the second handle portion and the third handle portion.

28. The method of claim 27, wherein the forming the handle comprises at least partially overlapping the second top end flap and the at least one side end flap so that the first line of weakening and the second line of weakening are at least partially overlapped.

29. The method of claim 28, wherein the at least one side end flap is a first side end flap foldably connected to the first side panel, the second line of weakening is in the first side end flap, and the plurality of end flaps comprises a second side end flap foldably connected to the second side panel, the third handle portion comprises a third line of weakening in the second side end flap, the fainting the handle comprises at least partially overlapping the second top end flap and the second side end flap so that the first line of weakening and the third line of weakening are at least partially overlapped.

30. The method of claim 27, further comprising activating the handle to cause the first handle portion and the second handle portion to move in an outward direction away from the interior of the carton and the third handle portion to move in an inward direction towards the interior of the carton.

31. The method of claim 27, wherein the blank further comprises a handle reinforcement flap foldably connected to the first top panel and is at least partially separable from the first top panel along a tear line, the tear line defines at least a portion of the first handle portion, the forming the handle comprises positioning the handle reinforcement flap in face-to-face contact with the first handle portion.

32. The method of claim 31, wherein a portion of at least one of the first handle portion and the handle reinforcement flap is in face-to-face contact with the third handle portion.

33. The method of claim 32, wherein a portion of the at least one of the first handle portion and the handle reinforcement flap is in face-to-face contact with the second handle portion.

34. A method of forming a carton for containing a plurality of articles, the method comprising:

obtaining a blank having a plurality of panels comprising a first top panel, a second top panel, a bottom panel, a first side panel, and a second side panel, a first plurality of end flaps foldably connected to a respective panel of the plurality of panels for at least partially closing a first end of the carton, the first plurality of end flaps comprise a first top end flap foldably connected to the first top panel and a second top end flap foldably connected to the second top panel, a second plurality of end flaps foldably connected to a respective panel of the plurality of panels for at least partially closing a second end of the carton, the second plurality of end flaps comprises a third top end flap foldably connected to the first top panel and a fourth top end flap foldably connected to the second top panel, and handle features for forming a handle, the handle comprising a first handle portion in the first top panel, a second handle portion in the second top panel, a third handle portion at least partially formed by a first line of weakening in the second top end flap, and a fourth handle portion at least partially formed by a second line of weakening in the fourth top end flap;

folding the plurality of panels to at least partially form an interior of the carton, the folding the plurality of panels comprising at least partially overlapping the first top panel and the second top panel to form a top wall; and forming the handle from the first handle portion, the second handle portion, and the third handle portion, the first handle portion extending into the first top end flap, the second handle portion being spaced apart from the first line of weakening, and the first handle portion is connected to the second handle portion and the third handle portion.

35. The method of claim 34, wherein the first handle portion extends into the third top end flap, the second handle portion is spaced apart from the second line of weakening at least partially forming the fourth handle portion, and the first handle portion is connected to the fourth handle portion.

36. The method of claim 34, wherein the second plurality of end flaps comprises at least one side end flap foldably connected to a respective one of the first side panel and the second side panel, the fourth handle portion comprises a third line of weakening in the at least one side end flap.

37. The carton of claim 1, wherein the second top end flap is foldably connected to the second top panel at a fold line, the third handle portion is spaced apart from the fold line.

38. The carton of claim 14, wherein the fourth top end flap is foldably connected to the second top panel at a fold line, the fourth handle portion is spaced apart from the fold line.

39. The blank of claim 16, wherein the second top end flap is foldably connected to the second top panel at a fold line, the third handle portion is spaced apart from the fold line.

40. The blank of claim 25, wherein the fourth top end flap is foldably connected to the second top panel at a fold line, the fourth handle portion is spaced apart from the fold line.

41. The method of claim 27, wherein the second top end flap is foldably connected to the second top panel at a fold line, the third handle portion is spaced apart from the fold line.

42. The method of claim 35, wherein the fourth top end flap is foldably connected to the second top panel at a fold line, the fourth handle portion is spaced apart from the fold line.

* * * * *